US008056632B2

(12) United States Patent
Goodman

(10) Patent No.: US 8,056,632 B2
(45) Date of Patent: Nov. 15, 2011

(54) DOWNHOLE INITIATOR FOR AN EXPLOSIVE END DEVICE

(75) Inventor: Kenneth R. Goodman, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 34 days.

(21) Appl. No.: 12/061,769

(22) Filed: Apr. 3, 2008

(65) Prior Publication Data

US 2009/0159285 A1 Jun. 25, 2009

Related U.S. Application Data

(60) Provisional application No. 61/015,730, filed on Dec. 21, 2007.

(51) Int. Cl.
*E21B 43/1185* (2006.01)

(52) U.S. Cl. ..... 166/297; 166/55; 89/1.15

(58) Field of Classification Search ..... 166/63, 166/299, 55, 297; 102/313, 308, 310, 312; 175/2, 4.55, 4.56; 89/1.15
See application file for complete search history.

(56) References Cited

U.S. PATENT DOCUMENTS

| | | | | |
|---|---|---|---|---|
| 2,020,410 | A * | 11/1935 | Greene | 102/313 |
| 2,142,583 | A | 1/1939 | Yarbrough | |
| 2,664,158 | A * | 12/1953 | McKean | 175/4.53 |
| 3,183,972 | A | 5/1965 | Fredd | |
| 3,199,287 | A | 8/1965 | Kinley | |
| 4,292,895 | A | 10/1981 | Bell | |
| 4,306,628 | A | 12/1981 | Adams | |
| 4,523,650 | A | 6/1985 | Sehnert | |
| 4,561,356 | A | 12/1985 | Bordon | |
| 4,967,048 | A | 10/1990 | Langston | |
| 5,027,708 | A | 7/1991 | Gonzalez | |
| 5,070,788 | A | 12/1991 | Carisella | |
| 5,159,145 | A | 10/1992 | Carisella | |
| 5,161,615 | A | 11/1992 | Colla | |
| 5,165,489 | A | 11/1992 | Langston | |
| 5,223,665 | A | 6/1993 | Burleson | |
| 5,237,136 | A | 8/1993 | Langston | |
| 5,277,262 | A | 1/1994 | Huber | |
| 5,346,014 | A | 9/1994 | Ross | |
| 5,392,860 | A | 2/1995 | Ross | |
| 5,436,791 | A | 7/1995 | Turano | |
| 5,483,895 | A | 1/1996 | Tomek | |
| 6,095,258 | A | 8/2000 | Reese | |
| 6,167,809 | B1 | 1/2001 | Robinson | |
| 6,550,538 | B1 | 4/2003 | Herrmann | |
| 6,584,907 | B2 | 7/2003 | Boucher | |
| 6,779,605 | B2 | 8/2004 | Jackson | |
| 6,915,848 | B2 | 7/2005 | Thomeer | |
| 6,964,231 | B1 | 11/2005 | Robinson | |
| 7,116,542 | B2 * | 10/2006 | Lerche et al. | 361/248 |

(Continued)

FOREIGN PATENT DOCUMENTS

| | | | |
|---|---|---|---|
| DE | 3223775 | A1 * | 12/1983 |
| DE | 4112595 | A1 * | 11/1991 |
| GB | 2054107 | | 2/1981 |
| GB | 2369139 | | 5/2002 |
| GB | 2407333 | | 4/2005 |

(Continued)

*Primary Examiner* — Kenneth L Thompson
(74) *Attorney, Agent, or Firm* — Kevin Brayton McGoff; Fred Pruner

(57) ABSTRACT

A perforating gun that is usable with a well includes at least one perforating charge and a initiator. The initiator includes an explosive ballistic train to the perforating charge(s). The initiator is adapted to physically misalign components of the ballistic train to prevent inadvertent firing of the perforating charge(s) and physically realign the components to arm the ballistic train.

20 Claims, 4 Drawing Sheets

U.S. PATENT DOCUMENTS

| | | | |
|---|---|---|---|
| 7,171,309 | B2 | 1/2007 | Goodman |
| 7,284,612 | B2 | 10/2007 | Ratanasirigulchai |
| 7,487,833 | B2 | 2/2009 | Grigar |
| 2004/0231840 | A1 | 11/2004 | Ratanasirigulchai |
| 2006/0249045 | A1 | 11/2006 | Goodman |
| 2007/0034369 | A1 | 2/2007 | Ratanasirigulchai |
| 2007/0056724 | A1 | 3/2007 | Spring |
| 2007/0235187 | A1 | 10/2007 | Goodman |

FOREIGN PATENT DOCUMENTS

| | | |
|---|---|---|
| GB | 2416358 | 1/2006 |
| GB | 2431674 | 5/2007 |
| GB | 2432381 | 5/2007 |
| GB | 2432382 | 5/2007 |
| WO | 94/10422 | 5/1994 |
| WO | 9421882 | 9/1994 |

* cited by examiner

DOWNHOLE INITIATOR FOR AN EXPLOSIVE END DEVICE

CROSS REFERENCE TO RELATED APPLICATION

This application claims priority to provisional application Ser. No. 61/015,730 filed Dec. 21, 2007.

BACKGROUND

The present application generally relates to a downhole initiator, and more particularly, to an initiator for an oil or gas well environment, which contains a safety barrier to prevent inadvertent firing of the initiator.

Explosives typically are used in an oil or gas well for such purposes as perforating a well casing and forming perforation tunnels in a surrounding formation to enhance the productivity of the well. More specifically, a well tool called a perforating gun typically is run downhole in the well on a conveyance mechanism, such as a wireline, slickline, coiled tubing string, jointed tubing string, etc. When the perforating gun is in an appropriate position adjacent to the formation to be perforated, perforating charges (shaped charges, for example) of the perforating gun are fired to create perforating jets, which penetrate the casing and form the perforation tunnels in the formation.

A typical wireline-based perforating gun may include an initiator that is constructed to fire perforating charges of the gun after the initiator detects the appropriate command that is communicated downhole to the perforating gun from the surface of the well. The initiator may include an igniter, such as a semiconductor bridge (SCB), hot wire, exploding bridgewire (EBW) or TiB igniter, which is energized by the initiator after the initiator detects the command. When energized, the igniter sets off an explosive to begin a chain of explosive events that ultimately results in the initiation of a detonation wave on a detonating cord. The detonation wave causes the perforating charges (which are connected to the detonating cord) to fire.

Care typically is exercised for purposes of preventing inadvertent firing of the perforating charges. However, challenges remain in preventing an unintended triggering event, such as an electrostatic discharge (ESD) or a radio frequency (RF) signal, from causing inadvertent firing of the perforating charges.

SUMMARY

In an embodiment of the invention, a perforating gun that is usable with a well includes at least one perforating charge and an initiator. The initiator includes a ballistic train to fire the perforating charge(s). The initiator is adapted to misalign components of the ballistic train to disarm the initiator and realign the components to arm the initiator.

In another embodiment of the invention, a technique that is usable with a well includes providing an initiator to fire at least one perforating charge and preventing inadvertent firing of the perforating charge(s), including misaligning components of a ballistic train of the initiator.

In yet another embodiment of the invention, an initiator assembly includes a ballistic train to fire an end device in a well and an actuator to misalign components of the ballistic train to prevent inadvertent firing of the end device.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other Like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
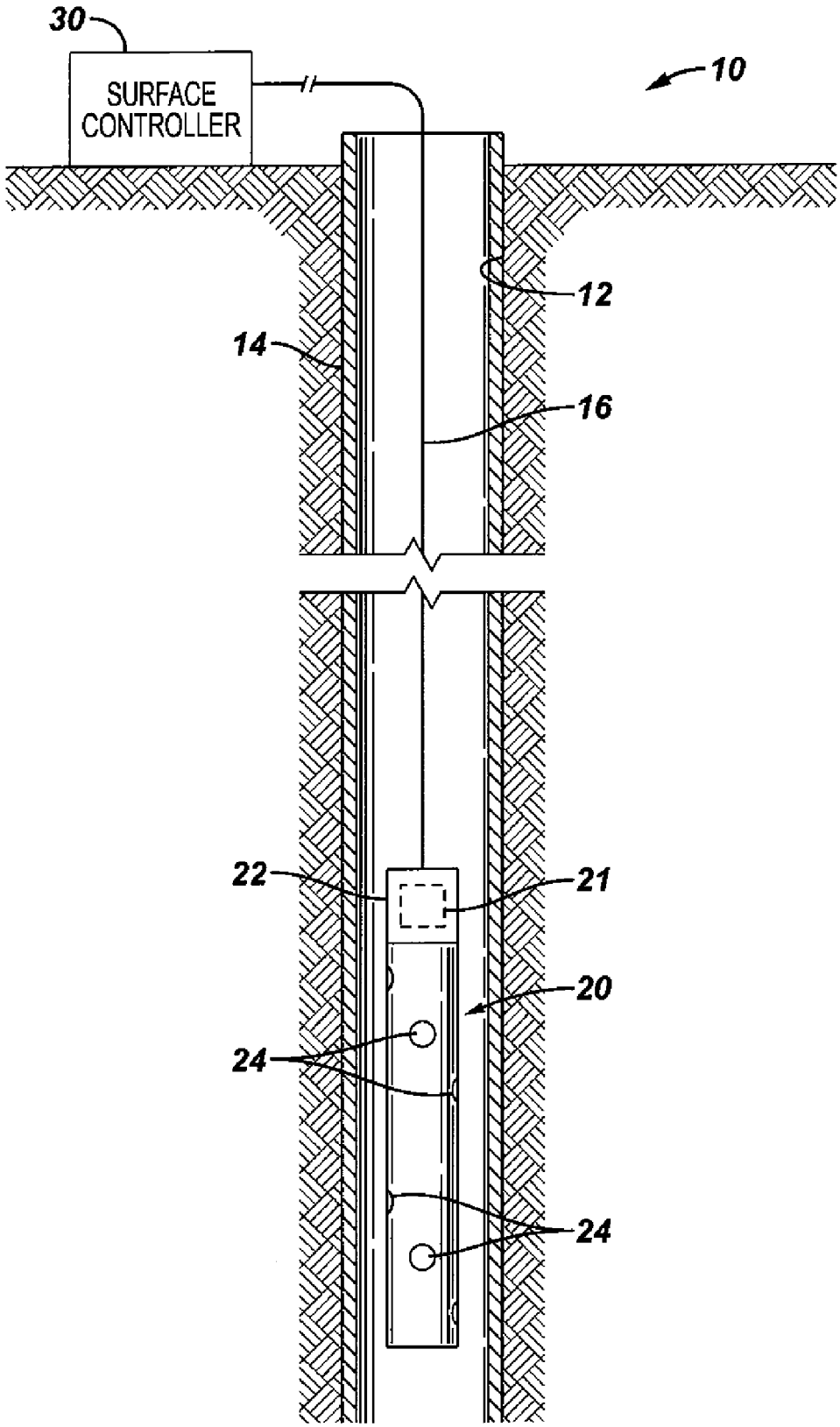
FIG. 1 is a schematic diagram of a well illustrating a perforating system according to an embodiment of the invention.

Referring to FIG. 1, a well 10 (a subsea or subterranean well, as examples) in accordance with embodiments of the invention includes a wellbore 12 that extends downhole through one or more formations. The wellbore 12 may or may not be lined with a casing string 14, depending on the particular embodiment of the invention. Furthermore, the wellbore 12 may be the main wellbore (as shown) or a lateral wellbore, depending on the particular embodiment.

For purposes of enhancing the productivity of the well 10, a perforating system may be run into the well 10 to perforate the casing string 14 (assuming the wellbore 12 is cased) and the surrounding formation. More specifically, a perforating gun 20 may be run downhole on a conveyance mechanism, which is generally denoted in FIG. 1 by reference numeral "16." Depending on the particular embodiment of the invention, the conveyance mechanism 16 may be a wireline, slickline, coiled tubing, jointed tubing, etc. Thus, many variations are contemplated and are within the scope of the appended claims.

The perforating gun 20 contains perforating charges 24 (shaped charges, for example), which are outwardly directed (radially or tangentially directed, as examples) to perforate the casing string 14 (if the wellbore 12 is cased) and form corresponding perforation tunnels into the surrounding formation. More specifically, the perforating charges 24 may be arranged in a particular phasing pattern (a helical or spiral phasing pattern, missing arc helical phasing pattern, a planar phasing pattern, etc.), depending on the particular perforating application. Furthermore, the perforating gun 20 may be, as examples, a hollow carrier gun in which the perforating charges 24 are protected by a sealed tube or an encapsulated perforating gun in which the perforating charges 24 are individually encapsulated or sealed.

The perforating charges 24 are ballistically coupled to an initiator 22 of the perforating gun 20. As a more specific example, the perforating charges 24 may be connected to one or more detonating cords (not shown) that are operatively coupled to the initiator 22.

In general, the initiator 22 is responsible for firing the perforating charges 24 in response to the detection of a command (herein called the "fire command") that may be generated at the surface of the well 10 by a surface controller 30 (for example) for purposes of arming the initiator 22 and causing the initiator 22 to fire the charges 24. The surface controller 30 may communicate the fire command downhole to the initiator 22 via signals that are communicated over one or more wires of a wireline (as a non-limiting example). Alternatively, the surface controller 30 may transmit the fire command downhole, along with an address of the perforating gun 20. In this regard, the perforating gun 20 may be one of several downhole perforating guns that are specifically addressed in communications from the surface. Wired or wireless stimuli that are generated at the surface of the well 10 may be used to communicate the fire command and possibly an address of the perforating gun 20 (if multiple perforating guns are present). It is assumed hereinafter that for these embodiments of the invention the fire command is intended for the perforating gun 20 and thus, for example, the fire command is associated with an address that targets the perforating gun 20.

The stimuli that are used to communicate the fire command to the perforating gun 20 may take on a number of different forms and may be electrical, mechanical or mechanical stimuli, as just a few non-limiting examples. As more specific examples, a fire command may be communicated downhole to the initiator 22 via up and down movement of the perforating gun 20 by movement of the conveyance mechanism 16; via an electrical signal that is communicated downhole on a wireline; via hydraulic pressure (tubing conveyed pressure or pressure pulses, as examples); via an electromagnetic signal that is communicated downhole on a tubing string; etc. Regardless of the particular form of the stimuli, in response to detecting the fire command, the initiator 22 initiates a detonation wave on a detonating cord, and the detonation wave propagates on one or more detonating cord(s) to the perforating charges 24 to cause the charges 24 to fire.

The initiator 22 contains certain safety features to ensure that the perforating charges 24 do not inadvertently fire. More specifically, the initiator 22 may contain one or more electrical switches for purposes of isolating a power source (a downhole battery, power communicated downhole via a wireline, a downhole pressure, etc.) from the final initiation component, such as an igniter of the initiator 22, until the initiator 22 detects the fire command. In general, to fire the perforating charges 24 once the fire command is detected, the initiator 22 activates the igniter to initiate a sequence of explosions in a ballistic train of the initiator 22, which ultimately results in the initiation of the detonation wave on the detonating cord.

As described herein, as an added safety barrier, in its unarmed state, the initiator 22 physically interrupts the ballistic train so that the firing of an explosive (such as a primary explosive, for example) on one end of the ballistic train does not result in the firing of an explosive on the opposite end of the ballistic train, which would initiate the detonation wave on the detonating cord. More specifically, the initiator 22 includes an actuator assembly 21 that is constructed to misalign components (explosives, for example) of the ballistic train to establish the unarmed state of the initiator 22. Therefore, even if an unintended triggering event, such as imparted radio frequency (RF) and/or electrostatic discharge (ESD) energy, initiates the firing of the first explosive (a primary explosive, for example) of the ballistic train, the discontinuity in the ballistic train terminates the chain of explosive events, thereby preventing unintended firing of the perforating gun 20.

Figure 2:
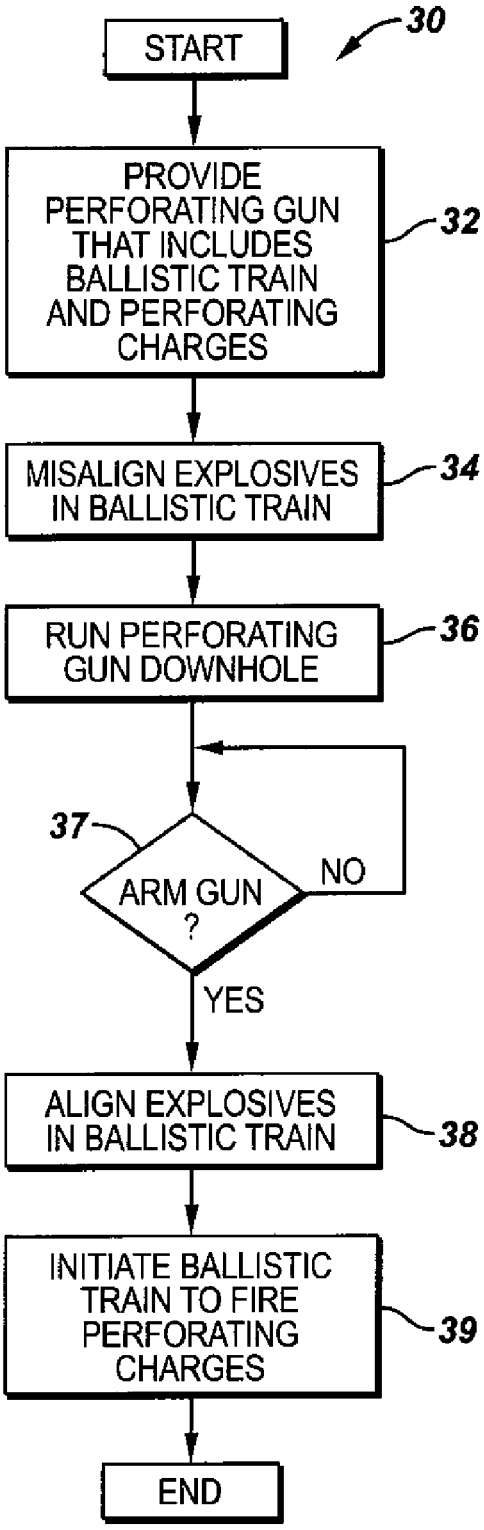
FIGS. 2 and 3 are flow diagrams depicting techniques to prevent inadvertent firing of the perforating system of FIG. 1 according to embodiments of the invention.

To summarize, FIG. 2 depicts a technique 30, in accordance with embodiments of the invention, for arming and disarming a perforating gun. The technique 30 includes providing a perforating gun that includes perforating charges and an initiator that has a ballistic train, pursuant to block 32. Explosives in the ballistic train are misaligned (block 34), and the perforating gun is run downhole, pursuant to block 36. The explosives are then aligned (block 38) in response to a determination (diamond 37) that the initiator 22 is to be armed. For example, the initiator 22 may determine that the initiator 22 is to be armed in response to detecting the above-described fire command. After the initiator 22 is armed, the technique 30 includes initiating the firing of the ballistic train, pursuant to block 39, for purposes of firing the perforating charges 24.

Figure 3:
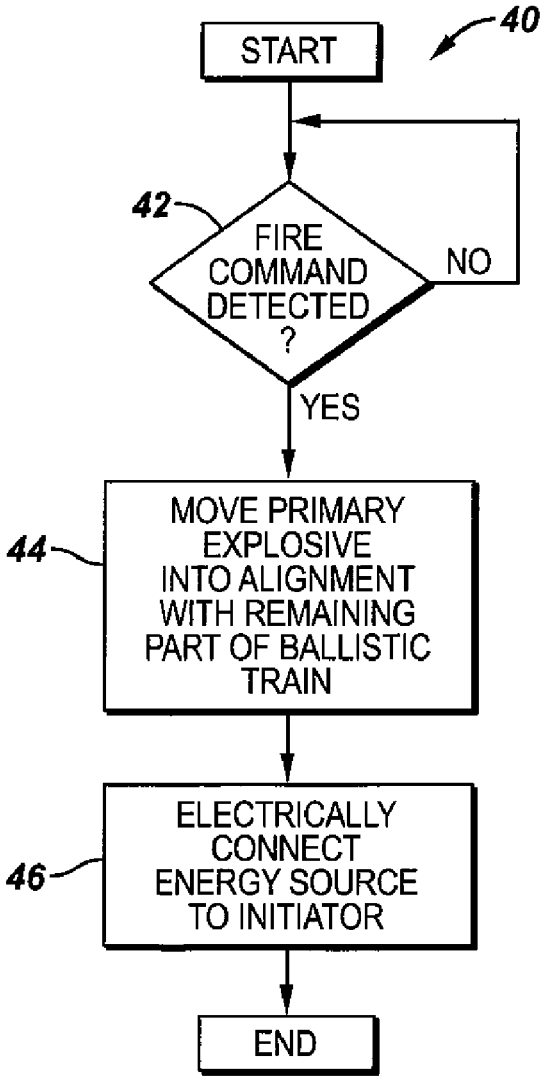

As a more specific example, FIG. 3 depicts an exemplary technique 40 that may be performed by the initiator 22 (see FIG. 1) in accordance with some embodiments of the invention. Referring to FIG. 3 in conjunction with FIG. 1, upon detecting the fire command (pursuant to diamond 42), the initiator 22 moves (block 44) a primary explosive of the ballistic train into alignment with the remaining part of the ballistic train. The initiator 22 then electrically connects an energy source to an igniter of the initiator 22, pursuant to block 46, for purposes of initiating the firing of the ballistic train, which results in the initiation of the detonation wave on the detonating cord and the firing of the perforating charges 24.

Figure 4:
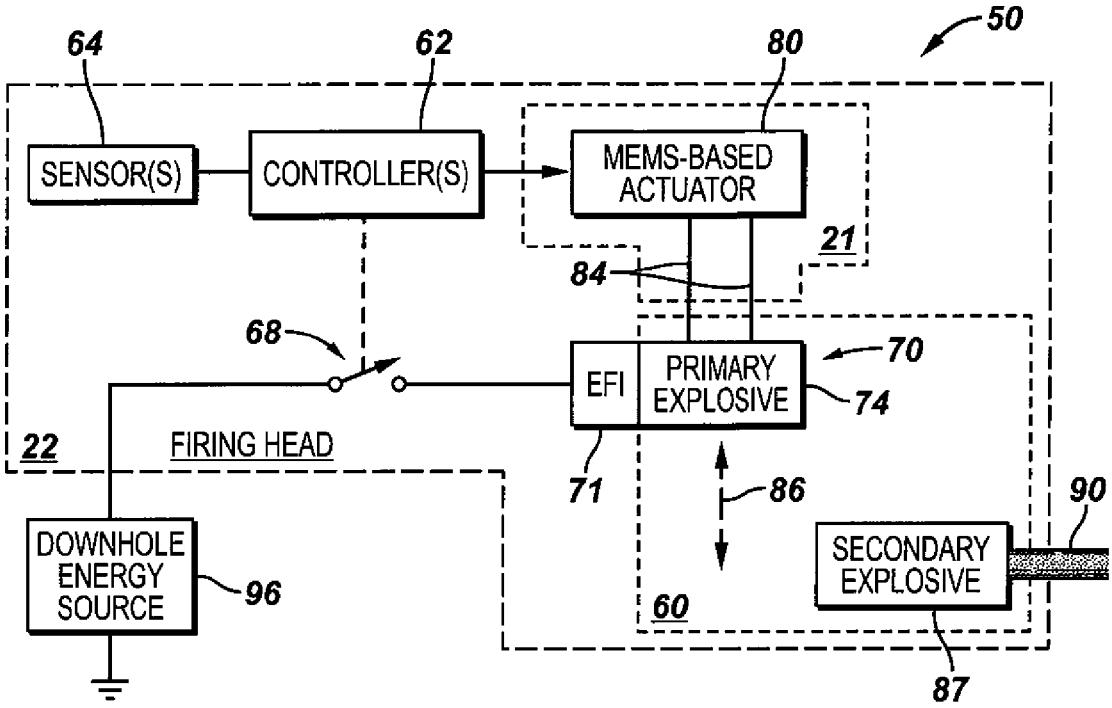
FIG. 4 depicts an initiator assembly in an unarmed state according to an embodiment of the invention.

FIG. 4 depicts an exemplary initiator assembly 50 in an unarmed state in accordance with some embodiments of the invention. Referring to FIG. 4 in conjunction with FIG. 1, for this example the initiator assembly 50 includes the initiator 22, a downhole energy source 96 and a detonation cord 90 that is operatively coupled to the perforating charges 24. As examples, the downhole energy source 96 may be a battery, a power cable that extends from the surface of the well, an AC and/or DC converter that converts energy supplied through a downhole power cable, etc. Regardless of the particular form of the downhole energy source 96, the downhole energy source 96 for this example provides electrical power that may be used to initiate the firing of a ballistic train 60 of the initiator 22. It is noted that in other embodiments of the invention, another source, such as wellbore pressure, may be used to provide a force that activates an igniter or other mechanism to initiate the firing of the ballistic train. Thus, many variations are contemplated and are within the scope of the appended claims.

The ballistic train 60 includes a primary explosive 74 and a secondary explosive 87, which for this example are physically misaligned (as shown in FIG. 4) in the unarmed state of the initiator assembly 50. In this context, misalignment of the explosives 74 and 87 means that the explosives 74 and 87 are positioned so that firing of the primary explosive 74 (which is the first explosive in the ballistic train for this example) does not initiate firing of the secondary explosive 87. The misalignment of the explosives 74 and 87 is to be contrasted to the alignment of the explosives 74 and 87 (as depicted in an armed state of the initiator assembly 60 in FIG. 5), which means that the explosives 74 and 87 are positioned so that firing of the primary explosive 74 initiates the firing of the secondary explosive 87. Alternate/additional to misalignment, components of the ballistic train can be separated or have barriers places there between.

The initiator 22 includes one or more sensors 64 for purposes of detecting the fire command, which may be communicated downhole through pressure pulses in the fluid of the well 10, electromagnetic signaling, seismic signaling or acoustic signaling, as a few non-limiting examples. The signals that are detected by the sensor(s) 64 may be processed by one or more controllers 62 of the initiator 22 for purposes of determining whether the fire command has been detected. In some embodiments of the invention, two controllers 62 may independently verify detection of the fire command before further action is taken to arm the initiator assembly 50 and fire the perforating charges 24.

In other embodiments of the invention, the fire command may be communicated downhole via signal, on a wireline. Therefore, for these embodiments of the invention, the sensors 64 may be replaced by a wireline telemetry interface.

The initiator 22 controls electrical communication between the energy source 96 and an igniter 71. As an example, this electrical communication may be controlled by a switch 68, which remains open (as depicted in FIG. 4) until the controller(s) 62 intend to fire the perforating charges 24. When the igniter 71 is energized (due to the closing of the switch 68), the igniter 71 forms a projectile that impacts the primary explosive 74 to initiate firing of the explosive 74.

Depending on the particular embodiment of the invention, the igniter 71 may be a semiconductor bridge (SCB), hot wire, exploding bridgewire (EBW) or TiB igniter. In some embodiments of the invention, the igniter 71 may be an exploding foil initiator (EFI). In yet other embodiments of the invention, the igniter may be a non-electrical-based igniter, such as a pressure activated igniter, as a non-limiting example.

In accordance with embodiments of the invention, the igniter 71 and the primary explosive 74 form a unit 70 that is translated along an axis 86 of motion by the actuator assembly 21 (see FIG. 1) of the initiator 22. In this regard, in response to the controller(s) 62 detecting the fire command, the controller(s) 62 communicate an electrical signal to the actuator assembly 21 to cause the assembly 21 to translate the unit 70 along the axis 86 until the primary explosive 74 is aligned with the secondary explosive 87, as depicted in an armed state of the detonating assembly 50 in FIG. 5. In accordance with some embodiments of the invention, upon detection of the fire command, the controller(s) 62 first activate the actuator assembly 21 to align the primary 74 and secondary 87 explosives and subsequently close the switch 68 to establish electrical communication between the downhole energy source 96 and the igniter 7.

Figure 5:
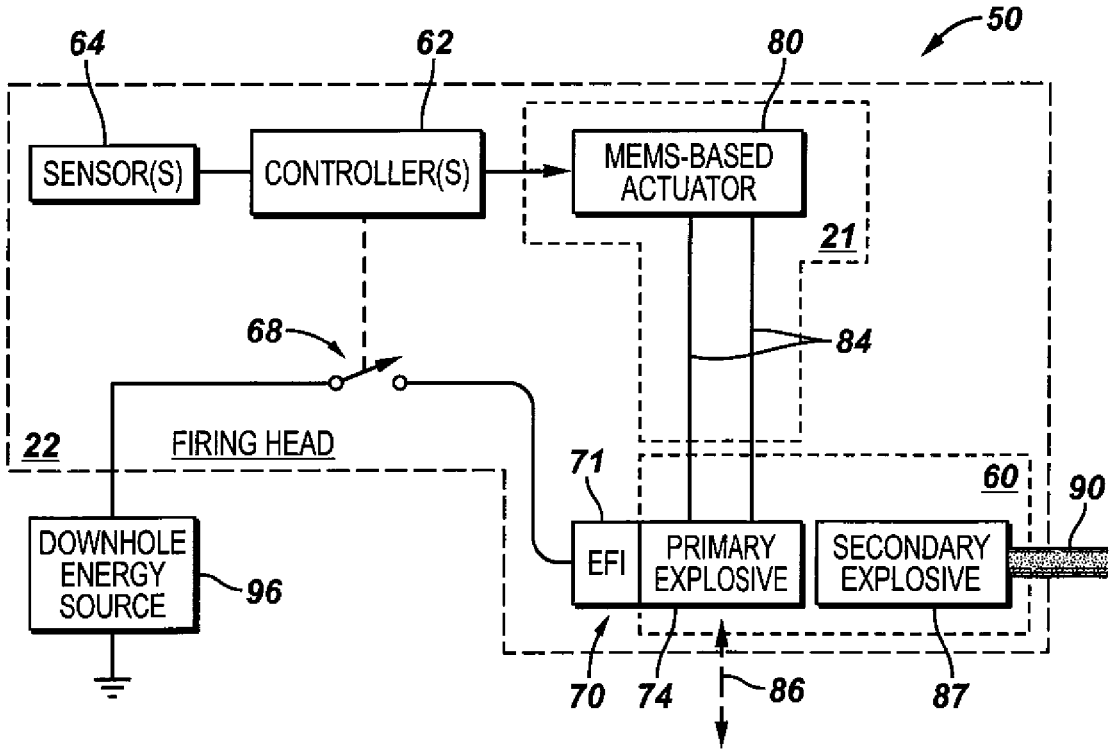
FIG. 5 depicts the initiator assembly in an armed state according to an embodiment of the invention.

The actuator assembly 21 may include a microelectromechanical system (MEMS)-based actuator 80, which moves an actuating member 84 that is attached to the unit 70 for purposes of translating the unit 70 along the axis 86. As shown in FIGS. 4 and 5, the axis 86 extends laterally to the secondary explosive 87 and does not intersect the secondary explosive 87. In accordance with some embodiments of the invention, the MEMS-based actuator 80 along with the actuating member 84 and the circuitry of the initiator 22 (such as the controller(s) 62, the sensor(s) 64, the switch 68, etc.) may be fabricated on a monolithic semiconductor substrate, although other packaging and/or fabrication techniques may be used in accordance with other embodiments of the invention. As non-limiting examples, the MEMS-based actuator 80 may be an electromagnetic, electrostatic, piezoelectric or thermal MEMS device, depending on the particular embodiment of the invention.

Figure 6:
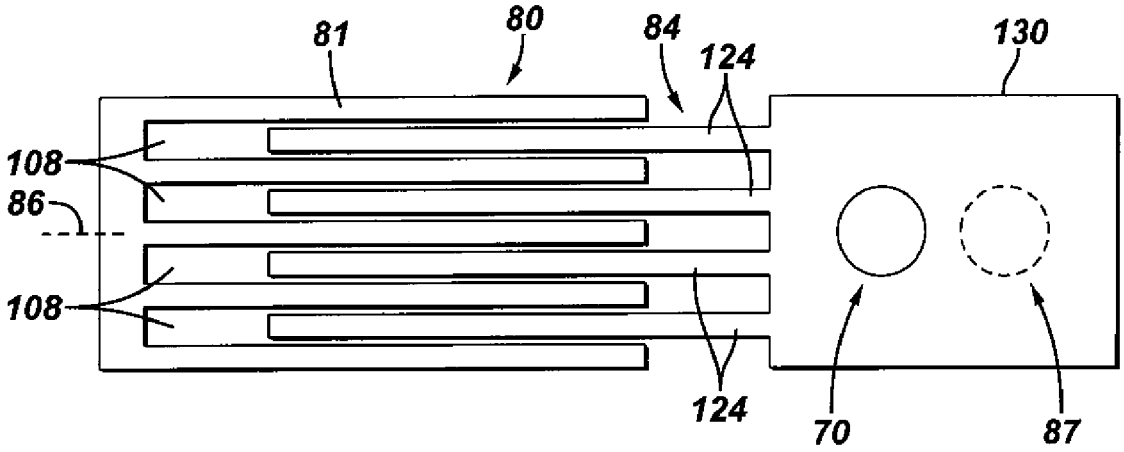
FIG. 6 is a schematic diagram of a MEMS-based actuator of the initiator assembly according to an embodiment of the invention.

As a more specific example, in accordance with some embodiments of the invention, the MEMS-based actuator 80 may be a comb-drive electrostatic actuator, which is depicted for purposes of example in FIG. 6. It is noted that the activator 80 of FIG. 6 is only an example, as other types of MEMS-based activators are contemplated and are within the scope of the appended claims. Referring to FIG. 6 in conjunction with FIG. 4, for these embodiments of the invention, the MEMS-based actuator 80 includes a stator 81 and the actuating element 84 that is constructed to translate in a controlled manner relative to the stator 81. The actuating element 84 is attached to a tray 130 that holds the unit 70.

The actuating element 84 includes longitudinally extending fingers 124 that are received into corresponding longitudinal slots 108 of the stator 81. The stator 81 and actuating element 84 are conductors, and a voltage is produced between the stator 81 and the actuating element 84 to produce a force that repels or attracts the actuating element 84 with respect to the stator 81, depending on the polarity of the voltage. Thus, to physically misalign the actuating element 84 with respect to the stator 81, an appropriate voltage is applied to attract the actuating element 84 to the stator 81, and likewise, to physically align the explosives, the opposite voltage is applied to attract the actuating element 84 to the stator 81.

As depicted in FIG. 6, at the end farthest from the stator 81, the actuating element 84 is attached to the tray 130, which is mounted to the unit 70. As shown in FIG. 6, the unit 70 is misaligned with the secondary explosive 87 (which may be below the tray 130, as shown) in the initiator assembly's unarmed state. When the appropriate voltage is applied to repel the actuating element 84 with respect to the stator 81, the unit 70 becomes aligned with the secondary explosive 87 to transition the initiator assembly 50 into the armed state. In accordance with some embodiments of the invention, the fingers 124 contain underlying metallic layers, which may be electrically isolated by a dielectric layer from the upper portion of the fingers 124 for purposes of maintaining electrical contact with an underlying metal layer that is connected to the switch 68. Thus, when the switch 68 closes, power is communicated through the metal layer and through the conductive layers of the fingers 84 to the igniter 71 of the unit 70.

Other embodiments are within the scope of the appended claims. For example, the initiator assembly may be used in connection with a tool other than a perforating gun in accordance with other embodiments of the invention. More specifically, the initiator assembly may be used in connection with any downhole tool that operates in response to the firing of an explosive, a "one shot" tool (a one shot packer or a one shot valve, as non-limiting examples).

The advantages of the initiating systems and techniques that are disclosed herein may include one or more of the following. The initiating system is protected from inadvertent firing due to radio frequency (RF) signals or electrostatic discharge (ESD). A two barrier safety system is provided. A safety barrier is disclosed, which facilitiates the use of a primary explosive to set off a secondary explosive. The components of the initiator 22 may be integrated to facilitate complete assembly of the perforating gun in the shop. A primary explosive may be used in the ballistic train for simpler and more reliable initiation, due to the isolation of the primary explosive from the remainder of the ballistic train in the unarmed state of the detonating system.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A perforating gun usable with a well, comprising:
at least one perforating charge; and
an initiator comprising a ballistic train to fire said at least one perforating charge, the initiator adapted to:
misalign explosives of the ballistic train to prevent inadvertent firing of said at least one perforating charge; and
align the explosives to arm the ballistic train to fire said at least one perforating charge.

2. The perforating gun of claim 1, wherein the initiator is adapted to physically realign the explosives to arm the ballistic train in response to the initiator detecting a fire command communicated from the surface of the well.

3. The perforating gun of claim 1, wherein the initiator comprises an actuator to translate at least one of the explosives to selectively misalign and realign the components.

4. The perforating gun of claim 3, wherein the actuator comprises a microelectromechanical device.

5. The perforating gun of claim 1, wherein the ballistic train further comprises an igniter.

6. The perforating gun of claim 1, further comprising:
a detonating cord coupled to said at least one perforating charge and adapted to receive a detonation wave initiated by activation of the ballistic train by the initiator.

7. The perforating gun of claim 1, wherein the initiator is adapted to misalign the explosives with respect to alignment of the remaining portion of the ballistic train.

8. The perforating gun of claim 1, wherein the initiator is adapted to:
move and misalign explosives of the ballistic train to prevent inadvertent firing of said at least one perforating charge; and
move and align the explosives to arm the ballistic train to fire said at least one perforating charge.

9. A method usable with a well, comprising:
providing an initiator comprising a ballistic train to fire at least one perforating charge;
preventing inadvertent firing of said at least one perforating charge, comprising physically misaligning explosives of the ballistic train; and
firing a perforating gun, comprising physically realigning the explosives to arm the ballistic train.

10. The method of claim 9, further comprising:
physically realigning the explosives to arm the ballistic train in response to the detection of a fire command.

11. The method of claim 9, further comprising:
selectively moving at least one of the explosives to selectively misalign and realign the explosives.

12. The method of claim 11, wherein the act of moving the at least one of the explosives comprises actuating a microelectromechanical device to move the at least one of the explosives.

13. The method of claim 9, wherein the explosive ballistic train further comprises an igniter.

14. The method of claim 9, further comprising:
operatively coupling a detonating cord coupled to said at least one perforating charge and adapted to receive a detonation wave.

15. The method of claim 9, comprising physically moving and misaligning explosives of the ballistic train.

16. A system usable with a well, comprising:
a ballistic train to fire an explosive end device; and
an actuator to control alignment between explosives of the ballistic train, the actuator adapted to physically misalign the explosives to prevent inadvertent firing of the explosive end device.

17. The system of claim 16, further comprising:
a controller to cause the actuator to physically align the explosives of the explosive ballistic train in response to detection of a fire command.

18. The system of claim 16, wherein the actuator comprises a MEMS-based actuator.

19. The system of claim 16, wherein the end device comprises at least one perforating charge.

20. The system of claim 16, wherein the actuator is adapted to physically move and misalign the explosives to prevent inadvertent firing of the explosive end device.

* * * * *